United States Patent [19]

Zuber et al.

[11] 4,313,579

[45] Feb. 2, 1982

[54] TWISTLESS PAYOUT PACKAGE OF FILAMENTARY MATERIAL

[75] Inventors: Bretislav P. Zuber, Montreal; Munidas C. Pereira, Lasalle, both of Canada

[73] Assignee: Northern Telecom Limited, Montreal, Canada

[21] Appl. No.: 167,457

[22] Filed: Jul. 10, 1980

[51] Int. Cl.[3] ..... B65H 55/00

[52] U.S. Cl. ..... 242/163; 242/18 R; 242/125.1; 242/164; 242/171

[58] Field of Search ..... 242/163, 159, 170, 171, 242/132, 137, 137.1, 138, 141, 146, 18 R, 125.2, 125.1, 125.3

[56] References Cited

U.S. PATENT DOCUMENTS

| | | | |
|---|---|---|---|
| 2,634,922 | 4/1953 | Taylor, Jr. | 242/163 |
| 3,578,255 | 5/1971 | Gordon et al. | 242/163 X |
| 3,666,191 | 5/1972 | Hopko | 242/163 X |
| 3,677,491 | 7/1972 | Gerwig | 242/163 |
| 3,803,796 | 4/1974 | Newman et al. | 242/163 X |
| 4,019,636 | 4/1977 | Wise | 242/163 X |
| 4,022,399 | 5/1977 | Zajac | 242/163 |
| 4,057,203 | 11/1977 | Newman et al. | 242/163 |
| 4,057,204 | 11/1977 | Zajac | 242/163 |

FOREIGN PATENT DOCUMENTS

| | | | |
|---|---|---|---|
| 2721116 | 12/1977 | Fed. Rep. of Germany | 242/163 |

*Primary Examiner*—Stanley N. Gilreath
*Attorney, Agent, or Firm*—R. J. Austin

[57] ABSTRACT

The winding of an internal payout package of flexible filamentary material by having a projection from the winding drum surface so that windings crossing the projection are deflected to one side or the other of the projection. The projection thus forms a radial opening in the package for internal payout of the material. Further, if the projection is tubular and is removed with the package from the drum, it assists in locating the package in position within a closure and the inner end of the package is then fed through the projection and out of the closure for payout purposes.

11 Claims, 9 Drawing Figures

TWISTLESS PAYOUT PACKAGE OF FILAMENTARY MATERIAL

This invention relates to twistless payout packages of filamentary material.

For the payout of flexible filamentary material from a wound package which is held in a stationary position, it has been found desirable to commence payout from an inner end of the material by passing the inner end out through a hole formed in the package to draw the material from the inside of the package and progressively towards the outside. Such a package will be referred to throughout this specification as an "internal payout" package.

In the formation of a straight hole extending radially through the package of figure 8 windings provided to give twistless payout, a complex winding operation for building the package has previously been necessary. For instance as disclosed in Canadian Pat. No. 970,749, granted to Windings Inc., in a package of flexible material having a transverse opening through the coils into a core space, the coils or windings in one layer are spaced apart longitudinally of the package by a greater distance than coils or windings in adjacent layers.

Further, in Canadian Pat. No. 999,569 also granted to Windings Inc., it is deemed necessary to build up successive layers of figure 8 winds with cross-overs progressing successively around the package, by changing the relative speed of rotation of a spindle and the movement of a guide element or by changing the angular shift of the spindle with respect to the guide element to form holes between the windings in the same radius. This provides a radial opening.

It is an object of the present invention to provide a method of winding a package of flexible filamentary material and providing a radial opening into a core space of the package while avoiding the winding complexities of the above known methods.

Accordingly, the present invention provides a method of winding an internal payout package of flexible filamentary material comprising providing a winding drum with a localized projection extending radially outwards from the winding surface, and winding the filamentary material onto the drum to form the package, the localized projection serving to deflect any windings, which would otherwise cross the region of the projection, to one side or the other of the projection so that a radial opening is formed by the projection through the package.

Preferably, the localized projection comprises a tubular element serving to act as a guide member for internal payout of the package. Hence, in this preferred method, after winding of the package, the package with the tubular element retained in position through the package, is removed from the winding drum.

The invention also includes a method of winding a package according to the invention as defined above in which the projection comprises a tubular element and of enclosing the wound package wherein the package is removed from the drum together with the tubular element, locating the package and element within a closure, aligning the tubular element with a hole in the wall of the closure, and securing the tubular element in place in alignment with said closure hole. For purposes of assisting in the later payout of the material, it is advantageous to pass the inner end of the package through the tubular element and hold said end projecting from the element between the tubular element and a locking member in engagement with the outer end of the tubular element to hold it in alignment with the closure hole.

According to another aspect of the invention, an internal payout package of wound flexible filamentary material comprises a tubular element extending radially through the package from a central open area to the outside of the package, the tubular element having retaining means at its inner end for holding it upon a winding drum.

The invention further includes an enclosed internal payout package as defined above wherein the package is located within a closure with an outer end of the tubular element in alignment with a hole defined in a closure wall, and a locking member in engagement with the tubular element to hold it in alignment with the hole in the closure wall.

The invention includes, in addition, a winding drum for winding a package wherein the drum has a winding surface and is provided with means for holding a localized projection in a position extending radially outwardly from the surface.

One embodiment of the invention will now be described by way of example, with reference to the accompanying drawings in which.

Figure 1:
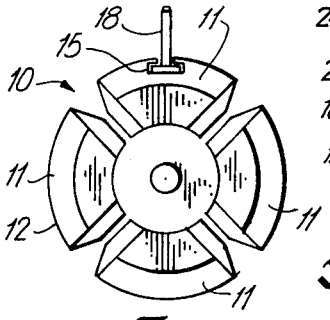
FIG. 1 is an end elevational view of a collapsible winding drum fitted with a localized projection.
Figure 3:
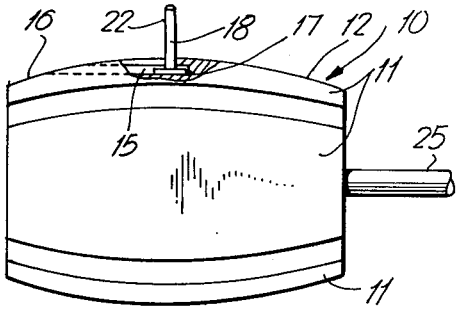
FIG. 3 is a side elevational view of the drum on the same scale as FIG. 1.

As shown in FIG. 1, a winding drum 10 for winding an internal payout package of flexible filamentary material is basically of conventional construction in that it comprises a plurality (which may be four as in this case) axially-extending arcuate segments 11 disposed circumferentially side-by-side to form the body of the drum with a discontinuous building surface 12. The segments are collapsible radially inwardly at one end in conventional manner and therefore no details are given for this. FIG. 3 shows the drum in normal uncollapsed condition and FIG. 5 with the drum collapsed.

Figure 2:
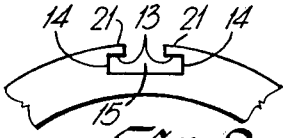
FIG. 2 is an end view of a segment of the drum and on a larger scale than FIG. 1.

The drum differs from the conventional construction and, according to the invention comprises means for holding a localized projection in a position extending radially outwardly from the surface 12. The holding means comprises abutment and guide surfaces 13, 14 of wide-base, narrow-neck slot, i.e. an inverted 'T'-shaped slot 15 (FIG. 2), formed axially along one of the segments 11, merging with and opening at a tapered part 16 of the surface 12 (FIG. 3) and extending to a stop surface 17 at the other end of the slot just past the mid-circumferential plane of the drum.

Figure 4:
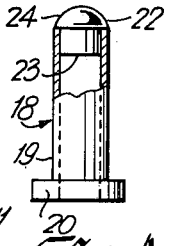
FIG. 4 is a view of the localized projection on a larger scale than FIG. 1.

As shown in FIG. 4, a localized projection 18 to be held upon the drum, comprises a tubular element 19 having at one end a radially outwards flange 20 which may be of any shape in end view (not shown), preferably circular, but which is of suitable dimensions to be slidably received within the wide base of the T-shaped slot 15. Overhanging edges 21 of the slot and provided with the abutment surfaces 13, are spaced-apart to slidably received the tubular element 19. The other end of the tubular element has a closure cap 22 having a reduced diameter end 23 which is insertable into the tubular element as a push fit as shown by FIG. 4. The other end 24 of the cap is smoothly rounded and is conveniently of part spherical shape.

In use of the drum to wind a package of flexible filamentary material, e.g. insulated telephone conductor, the drum is fitted with the projection 18, the flange 20 of which is slid along the slot 15 from its open end until the projection is substantially in a mid-axial position on the drum and in contact with surface 17. As shown by FIGS. 1 and 3, the tubular element 19 extends upwards from the drum with its rounded cap 22 uppermost.

The drum is rotated in normal fashion upon a mounting drive shaft 25 extending from a machine (not shown). The filamentary material 26 is then wound upon the drum to provide figure 8 windings to give a twistless payout as is known. The cross-over positions of the windings progress around the drum in a conventional fashion to provide a package of substantially uniform wind throughout. As methods of providing figure 8 windings are known, they will not be described further except to say, that no complex winding pattern is necessary for the purpose of making a straight hole extending radially through the package to provide for payout of the package from its inner end.

Instead, a straight radial hole is formed according to the invention by the use of the projection 18. As winding proceeds around the drum, any windings which would normally be positioned across the region of the projection 18, contact the rounded end 24 of the cap 22 and are deflected thereby either to one side or the other of the projection. The projection, because of its presence, therefore causes the formation of the hole.

Figure 5:
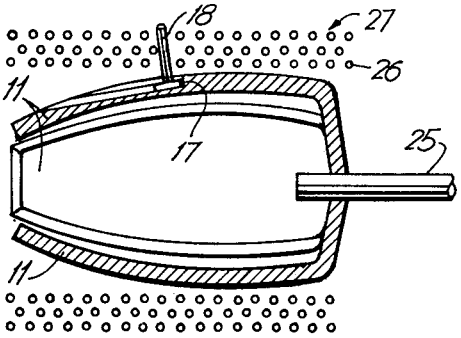
FIG. 5 is a cross-sectional view taken along the drum axis showing the drum in a collapsed state and ready for removal of a wound package.

The completed package 27 is then removed from the drum together with the projection 18. As shown in FIG. 5, for package removal, the drum is collapsed in normal manner by inward movement of the segments at their unsupported ends. During removal of the package, the projection 18 slides along the slot 15 and off the drum at the open end of the slot.

Figure 6:
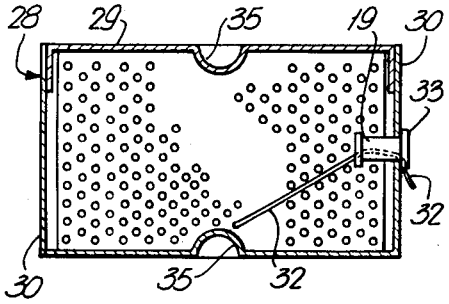
FIG. 6 is a cross-sectional view on the scale of FIG. 1 of a wound package enclosed within a closure.
Figure 7:
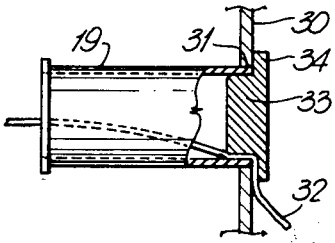
FIG. 7 is a cross-sectional view of part of the package within the closure and on a larger scale than FIG. 6, and showing a method of securing the projection to the closure.

The package still retaining the projection is then located within a closure. As shown in FIGS. 6 and 7, the closure comprises a cardboard box 28, which may be opened at least at one end 29 to admit the package between walls 30. The one wall 30 is formed with a hole 31 which is of sufficient diameter comfortably to receive the tubular element 19. The package is inserted axially into the box with the projection 18 positioned for movement towards the hole 31. The windings of the package are then compressed by hand to dispose the package completely within the box but also to manipulate the position of the projection 18 until upon coming into alignment with hole 31, the projection is guided into the hole by the rounded surface 24. Thus this rounded surface performs the double function of deflecting the windings around the projection and of guiding the projection into its hole in the closure. It should be understood that shapes for the surface 24 may be provided other than hemispherical while enabling the surface to perform its double function. The surface should however, be of a sloping nature, whether the slope is of rounded or flat configuration. The end cap is then removed.

To assist in the later payout of the material from the box, the inner end 32 of the package is then passed through the hole in the package, i.e. through the tubular element 19 to the outside of the box as shown in FIGS. 6 and 7. This is easily done manually with the box open by inserting a hand into the package and feeding the end 32 into element 19. The projecting end 32 is then held in place by a locking member to grip it against element 19. In this case, the locking member is a tapered plug 33 dimensioned to frictionally engage against the inside of the element 19 so as to grip the end 32 as shown in FIG. 7. The plug is formed with a head 34 to assist its removal.

As is noticeable from above, the hole is easily formed in the package 27 without the need of elaborate winding techniques. In addition, because of the continued presence of the projection 18 in the package, any disturbance of the package does not result in the hole becoming ill-defined by relative movement of the windings. Thus, the hole is easily found for alignment with the hole in the box and the feeding of the inner end of the material through the hole is relatively simple. Further, the sometimes difficult conventional operation of inserting a spigot through the outside of the box and into an ill-defined hole is avoided.

With the box finally closed to enclose the internal payout package 27, ends of the box are formed with domes 35 which locate axially within the ends of the package. These domes assist in guiding the filamentary material to a central position in alignment with the projection 18 during unwinding and thus help in the ease of unwinding.

Figure 8:
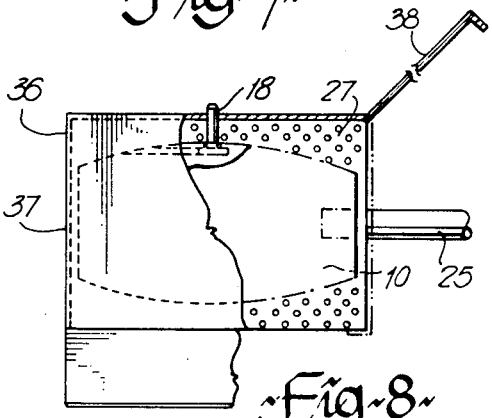
FIGS. 8 and 9 are cross-sectional views from the side and end of a wound package on the drum and showing a different method of enclosing the package.
Figure 9:
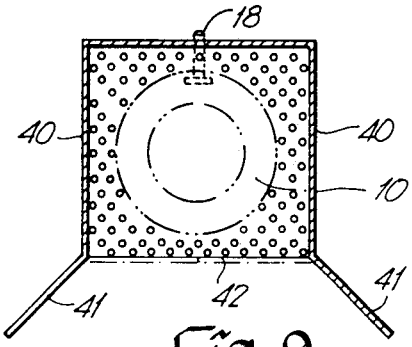

In a modification of the embodiment and as shown in FIGS. 8 and 9, the package 27 is partly enclosed within a box 36 before being removed from the drum.

As shown after winding of the package as described above, the box with an end 37 closed and a flap for the other end 38 bent back is located over the projection 18 to pass the projection through a hole in the top side 39 of the box. As seen in FIG. 9, two downwardly depending sides 40 of the box have flaps 41 to close together and form the fourth side of the box. This fourth side 42 (shown in dotted in FIG. 9) may then be closed before removal of the box containing the package or may remain open until package removal from the drum. If the side 42 is closed before package removal, it may be done easily by drum rotation until the flaps point upwardly and are in a more accessible position.

The drum is then collapsed as described in the first embodiment and the package within the box is removed. The flap 38 is then closed to completely enclose the package and after the inner end of material has been passed through the projection and locked in place as described in the first embodiment.

The modification described above is particularly useful upon a machine provided with a feeding means for bringing open boxes to the drum in succession and upon demand by the operator.

What is claimed is:

1. A method of winding an internal payout package of flexible filamentary material comprising providing a winding drum with a localized projection axially slidably received by a holding means of the drum to extend radially outwards from a winding surface of the drum in a fixed radial position relative to the drum, winding the filamentary material onto the drum to form the package, deflecting any windings which would otherwise cross the region of the projection, to one side or the other of the projection and thereby forming a radial opening by the projection through the package, and removing the package together with the projection from the drum by axial movement of the package accompanied by axial sliding removal of the projection from the holding means.

2. A method of winding a package and of enclosing the wound package comprises winding the package according to claim 1 onto the drum and about the projection which comprises a tubular element, removing the package together with the tubular element from the drum, locating the package and element within a closure, aligning the tubular element with a hole in the wall of the closure, and securing the tubular element in place in alignment with said closure hole.

3. A method according to claim 2 comprising securing the tubular element in place by means of a tapered plug inserted into the tubular element from outside the closure.

4. A method according to claim 2 including passing the inner end of the filamentary material through the tubular element and holding said end projecting from the element.

5. A method according to claim 4 comprising holding said end between the tubular element and a locking emember in engagement with the outer end of the element.

6. An internal payout package of wound flexible filamentary material comprising a tubular element extending radially through the package from a central open area to the outside of the package, the tubular element having a flange at its inner end forming a retaining means to hold it upon a winding drum.

7. An enclosed internal payout package comprising a closure and an internal payout package according to claim 6, the package located within the closure with the closure defining a hole in one closure wall and the tubular element having an outer end in alignment with said hole, and a locking member in engagement with the tubular element to hold it in alignment with the hole in the closure wall.

8. An enclosed package according to claim 7 wherein the locking member is a tapered plug fitted into frictional engagement with the inside of the tubular element from the outside of the closure.

9. An enclosed package according to claim 8 wherein the package has an end of said filamentary material which extends from the central open area and through the tubular element to project therefrom, the tapered plug and tubular element holding the end between them.

10. A winding drum for winding a package and having a winding surface which is provided with means for holding a localized projection in a fixed radial position extending radially outwardly from the surface, said means comprising a wide-base and and narrow-necked axially extending slot in said surface, the slot having axial guide surfaces and an axial facing end opening for acceptance of the projection to be slid axially along the slot.

11. A drum according to claim 10, in combination with a projection, said projection having a flange to be received through the end opening for axial sliding reception along the wide base of the slot and with the projection extending through the narrow neck of the slot.

* * * * *